US006701624B1

(12) United States Patent
White

(10) Patent No.: US 6,701,624 B1
(45) Date of Patent: Mar. 9, 2004

(54) KNIFE WITH ERGONOMIC HANDLE

(76) Inventor: Christopher R. White, 12043 Gulfstream Blvd., Port Charlotte, FL (US) 33981

( * ) Notice: Subject to any disclaimer, the term of this patent is extended or adjusted under 35 U.S.C. 154(b) by 25 days.

(21) Appl. No.: 10/099,017

(22) Filed: Mar. 15, 2002

(51) Int. Cl.[7] ..... B26B 3/00; B26B 29/02

(52) U.S. Cl. ..... 30/295; 30/340; D8/107; D22/118

(58) Field of Search ..... 30/286, 295, 298, 30/340, 344; D7/649; D22/118; D8/107

(56) References Cited

U.S. PATENT DOCUMENTS 472,006 A * 3/1892 Walker et al. ..... 30/295
2,520,355 A * 8/1950 Bell ..... 30/340
D202,780 S 11/1965 Baer
D226,410 S * 2/1973 Kunze ..... D7/649
D248,039 S * 5/1978 Hoffman ..... D22/118
D250,567 S * 12/1978 Breger ..... D7/649
D257,686 S 12/1980 Silva
4,578,864 A 4/1986 Hoffman
5,365,666 A 11/1994 Gonzalez
D363,336 S 10/1995 Luchak
5,568,689 A 10/1996 Gold
D397,018 S * 8/1998 Mosley ..... D8/107
6,460,255 B1 * 10/2002 Dassaud ..... 30/340

* cited by examiner

*Primary Examiner*—Hwei-Siu Payer

(57) ABSTRACT

A knife with ergonomic handle for providing a user with greater safety and control when using the knife. The knife with ergonomic handle includes a blade member having a cutting edge; and also includes a handle assembly being attached to the blade member and having mirrored handle members being fastened side-by-side about a portion of the blade member with each of the mirrored handle member having a main portion and an elongate end portion extending from the main portion with the main portion being adapted to protect a user's index finger and thumb.

4 Claims, 1 Drawing Sheet

KNIFE WITH ERGONOMIC HANDLE

BACKGROUND OF THE INVENTION

1. Field of the Invention

The present invention relates to ergonomic knives and more particularly pertains to a new knife with ergonomic handle for providing a user with greater safety and control when using the knife.

2. Description of the Prior Art

The use of ergonomic knives is known in the prior art. More specifically, ergonomic knives heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,365,666; U.S. Pat. No. 4,578,864; U.S. Pat. No. Des. 202,780; U.S. Pat. No. 5,568,689; U.S. Pat. No. Des. 257,686; and U.S. Pat. No. Des. 363,336.

While these devices fulfill their respective, particular objectives and requirements, the aforementioned patents do not disclose a new knife with ergonomic handle. The inventive device includes a blade member having a cutting edge; and also includes a handle assembly being attached to the blade member and having mirrored handle members being fastened side-by-side about a portion of the blade member with each of the mirrored handle member having a main portion and an elongate end portion extending from the main portion with the main portion being adapted to protect a user's index finger and thumb.

In these respects, the knife with ergonomic handle according to the present invention substantially departs from the conventional concepts and designs of the prior art, and in so doing provides an apparatus primarily developed for the purpose of providing a user with greater safety and control when using the knife.

SUMMARY OF THE INVENTION

In view of the foregoing disadvantages inherent in the known types of ergonomic knives now present in the prior art, the present invention provides a new knife with ergonomic handle construction wherein the same can be utilized for providing a user with greater safety and control when using the knife.

The general purpose of the present invention, which will be described subsequently in greater detail, is to provide a new knife with ergonomic handle which has many of the advantages of the ergonomic knives mentioned heretofore and many novel features that result in a new knife with ergonomic handle which is not anticipated, rendered obvious, suggested, or even implied by any of the prior art ergonomic knives, either alone or in any combination thereof.

To attain this, the present invention generally comprises a blade member having a cutting edge; and also includes a handle assembly being attached to the blade member and having mirrored handle members being fastened side-by-side about a portion of the blade member with each of the mirrored handle member having a main portion and an elongate end portion extending from the main portion with the main portion being adapted to protect a user's index finger and thumb.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knife with ergonomic handle which has many of the advantages of the ergonomic knives mentioned heretofore and many novel features that result in a new knife with ergonomic handle which is not anticipated, rendered obvious, suggested, or even implied by any of the prior art ergonomic knives, either alone or in any combination thereof.

It is another object of the present invention to provide a new knife with ergonomic handle which may be easily and efficiently manufactured and marketed.

It is a further object of the present invention to provide a new knife with ergonomic handle which is of a durable and reliable construction.

An even further object of the present invention is to provide a new knife with ergonomic handle which is susceptible of a low cost of manufacture with regard to both materials and labor, and which accordingly is then susceptible of low prices of sale to the consuming public, thereby making such knife with ergonomic handle economically available to the buying public.

Still yet another object of the present invention is to provide a new knife with ergonomic handle which provides in the apparatuses and methods of the prior art some of the advantages thereof, while simultaneously overcoming some of the disadvantages normally associated therewith.

Still another object of the present invention is to provide a new knife with ergonomic handle for providing a user with greater safety and control when using the knife.

Yet another object of the present invention is to provide a new knife with ergonomic handle which includes a blade member having a cutting edge; and also includes a handle assembly being attached to the blade member and having mirrored handle members being fastened side-by-side about a portion of the blade member with each of the mirrored handle member having a main portion and an elongate end portion extending from the main portion with the main portion being adapted to protect a user's index finger and thumb.

Still yet another object of the present invention is to provide a new knife with ergonomic handle that is easy and convenient to use.

Even still another object of the present invention is to provide a new knife with ergonomic handle that protects the user's fingers and thumb while using the knife to slice through foods such as meat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3:
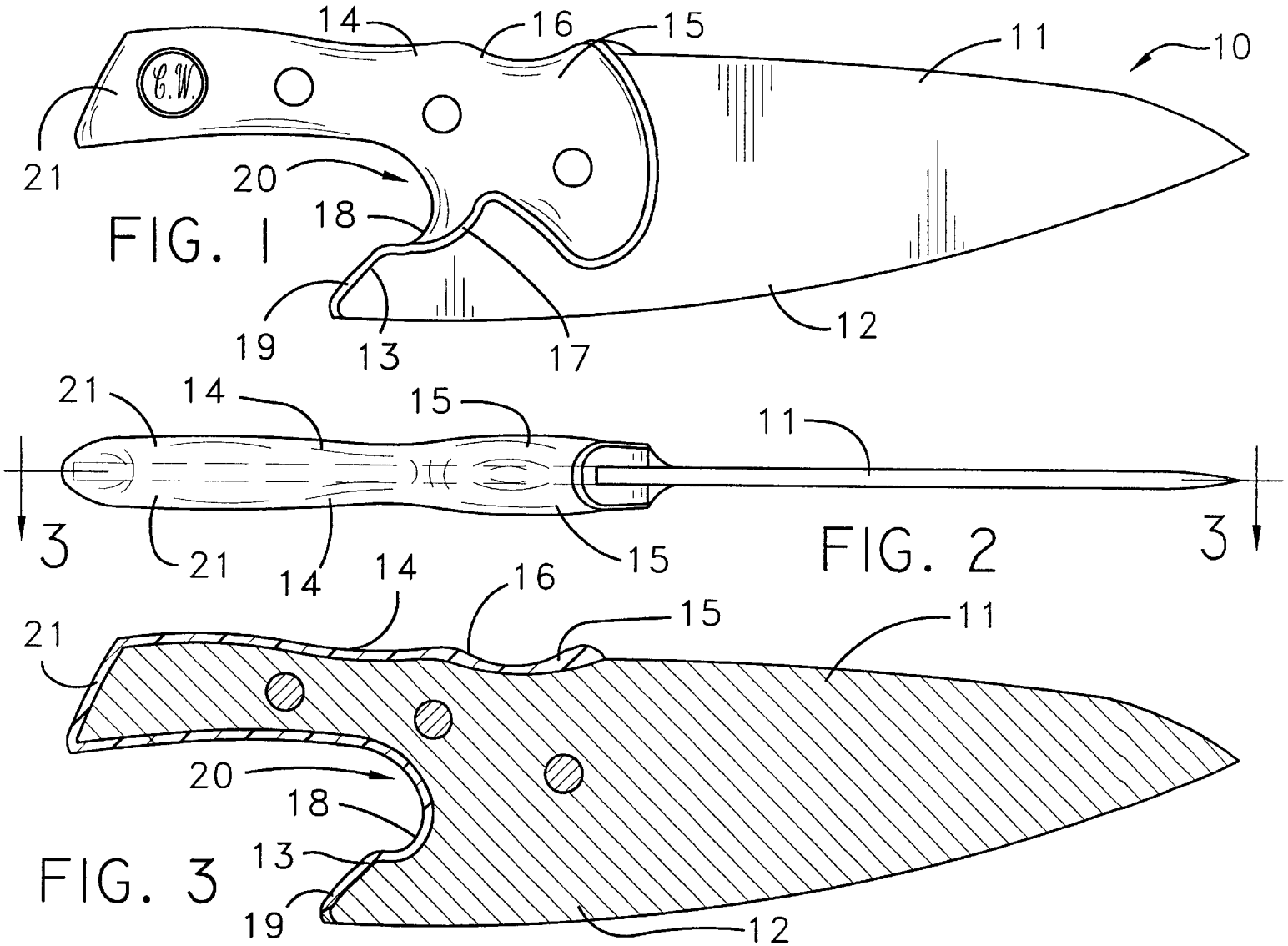
FIG. 1 is a side elevational view of a new knife with ergonomic handle according to the present invention.
FIG. 2 is a top edge view of the present invention.
FIG. 3 is a cross-sectional view of the present invention.

With reference now to the drawings, and in particular to FIGS. 1 through 3 thereof, a new knife with ergonomic handle embodying the principles and concepts of the present invention and generally designated by the reference numeral 10 will be described.

As best illustrated in FIGS. 1 through 3, the knife with ergonomic handle 10 generally comprises a blade member 11 having a cutting edge 12. A handle assembly is conventionally fastened to the blade member 11 and has mirrored handle members 14 being conventionally fastened side-by-side about a portion of the blade member 11. Each of the mirrored handle members 14 has a main portion 15 and an elongate end portion 21 integrally extending from the main portion 15 with the main portion 15 being adapted to protect a user's index finger and thumb. Each of the main portions 15 has a top edge 16, a bottom edge 17, a back edge 18, and an extended guard portion 19 which is integrally connected to the bottom and back edges 17,18 and which covers a back edge 13 of the blade member 11 so that the user's index finger and thumb do not come into contact with the blade member 11 while grasping the elongate end portions 21 of the handle assembly. The top edges 16 and the bottom edges 17 of the main portions 15 of the mirrored handle members 14 are sinusoidal to facilitate grasping of the handle assembly with a user's hand. Each of the main portions 15 has a curved slot 20 being disposed in the back edge 18 thereof and being adapted to receive a portion of a user's hand to facilitate holding and controlling the knife 10.

In use, the user grasps the handle members 14 with one's index finger and thumb being protected from the blade member 11 by the extended guard portions 19 so that the user does not cut one's index finger and thumb while slicing or cutting through foods.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knife with ergonomic handle comprising:

a blade member having a cutting edge; and a handle assembly being attached to said blade member and having mirrored handle members being fastened side-by-side about a portion of said blade member, each of said mirrored handle members having a main portion and an elongate end portion extending from said main portion with said main portion being adapted to protect a user's index finger and thumb;

each of said main portions has a top edge, a bottom edge, a back edge, and an extended guard portion which is connected to said bottom and back edges and which covers a back edge of said blade member so that the user's index finger and thumb do not come into contact with said blade member while grasping said elongate end portions of said handle assembly.

2. A knife with ergonomic handle as described in claim 1, wherein said top edges and said bottom edges of said main portions of said mirrored handle members are sinusoidal to facilitate grasping of said handle assembly with a user's hand.

3. A knife with ergonomic handle as described in claim 1, wherein said each of said main portions has a curved slot being disposed in said back edge thereof and being adapted to receive a portion of a user's hand for facilitate holding and controlling said knife.

4. A knife with ergonomic handle comprising:

a blade member having a cutting edge; and a handle assembly being attached to said blade member and having mirrored handle members being fastened side-by-side about a portion of said blade member, each of said mirrored handle members having a main portion and an elongate end portion extending from said main portion with said main portion being adapted to protect a user's index finger and thumb, each of said main portions having a top edge, a bottom edge, a back edge, and an extended guard portion which is connected to said bottom and back edges and which covers a back edge of said blade member so that the user's index finger and thumb do not come into contact with said blade member while grasping said elongate end portions of said handle assembly, said top edges and said bottom edges of said main portions of said mirrored handle members being sinusoidal to facilitate grasping of said handle assembly with a user's hand, said each of said main portions having a curved slot being disposed in said back edge thereof and being adapted to receive a portion of a user's hand to facilitate holding and controlling said knife.

* * * * *